United States Patent [19]

Mann

[11] Patent Number: 5,007,918

[45] Date of Patent: Apr. 16, 1991

[54] EAR PIERCING CARTRIDGE ASSEMBLY

[75] Inventor: Samuel J. Mann, Englewood, N.J.

[73] Assignee: Inverness Corporation, Fair Lawn, N.J.

[21] Appl. No.: 469,626

[22] Filed: Jan. 24, 1990

[51] Int. Cl.[5] ..... A44C 7/00; A61B 17/34

[52] U.S. Cl. ..... 606/188; 63/13

[58] Field of Search ..... 606/188, 185, 117; 227/67, 73; 63/1.1, 12, 13

[56] References Cited

U.S. PATENT DOCUMENTS

| | | | |
|---|---|---|---|
| 4,009,718 | 3/1977 | Hastings | 606/188 |
| 4,030,507 | 6/1977 | Mann | 606/188 |
| 4,079,740 | 3/1978 | Phalon | 606/188 |
| 4,191,190 | 3/1980 | Hastings | 606/188 |
| 4,527,563 | 7/1985 | Reil | 606/188 |
| 4,860,747 | 8/1989 | Sciara | 606/188 |
| 4,921,494 | 5/1990 | Neil | 606/188 |
| 4,931,060 | 6/1990 | Aué | 606/188 |

FOREIGN PATENT DOCUMENTS

| | | | |
|---|---|---|---|
| 2135171 | 8/1984 | United Kingdom | 606/188 |
| 2142538 | 1/1985 | United Kingdom | 606/188 |
| 2187960 | 9/1987 | United Kingdom | 63/13 |

*Primary Examiner*—C. Fred Rosenbaum
*Assistant Examiner*—William W. Lewis
*Attorney, Agent, or Firm*—Blum Kaplan

[57] ABSTRACT

An earlobe piercing cartridge assembly for maintaining a piercing earring sterile during storage, handling and piercing is provided. The assembly includes a piercing earring including a piercing pin and an ornamental head which may have a large diameter compared to the diameter of the push rod, or may be made of a soft material, and from which the piercing pin projects. A cartridge uniquely configured to receive the piercing earring includes an elongated opening partially supporting the piercing pin, and a further opening proximate the ornamental head of the earring, and in longitudinal alignment with the elongated opening, the elongated opening having a smaller lateral dimension than the further opening. A shield is adapted to fit inside the cartridge between the ornamental head of the piercing earring and the further opening. The shield is also adapted to distribute the pressure across the ornamental head from a push rod which enters the further opening and facilitates smooth, low effort ear piercing with accurate axial alignment with the concentric or non-concentric ornament.

11 Claims, 7 Drawing Sheets

FIG.10
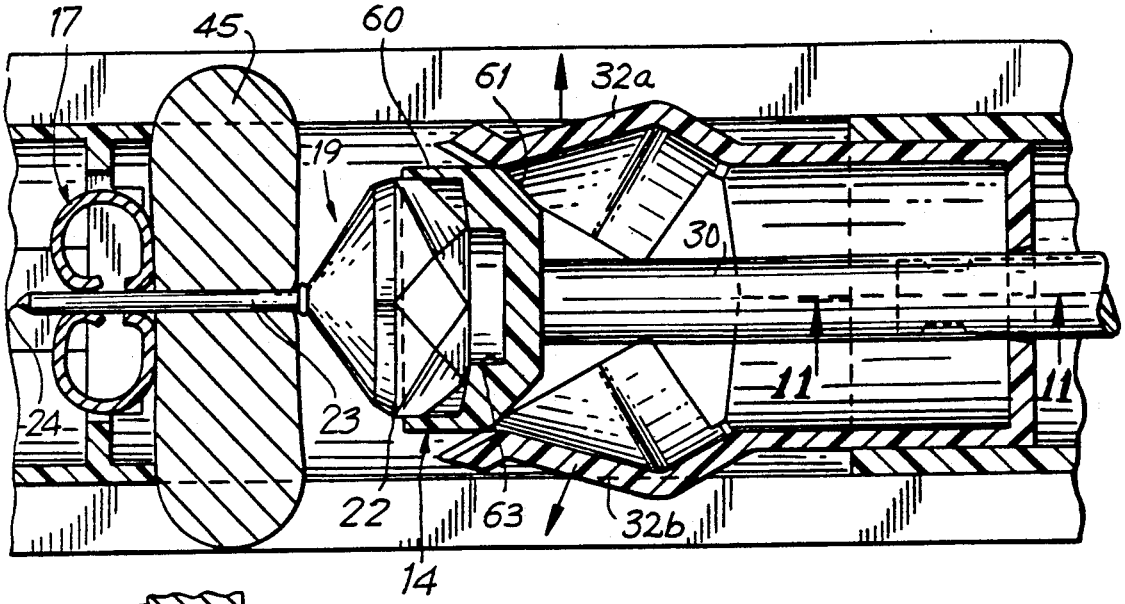
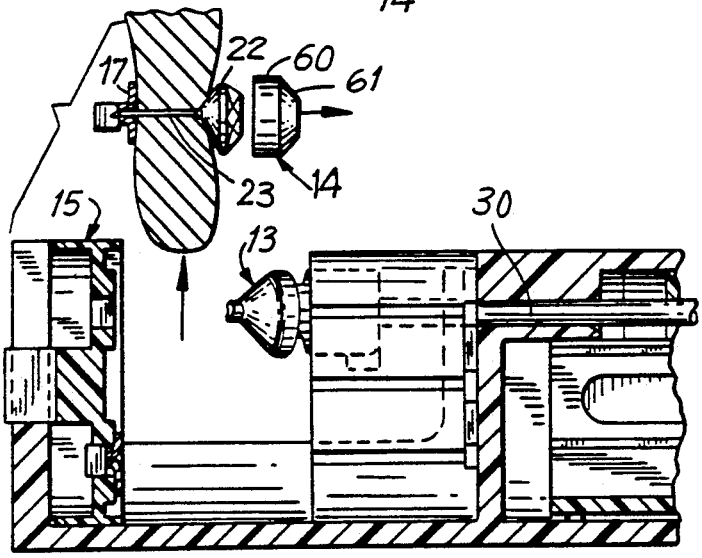
FIG.12
FIG.11
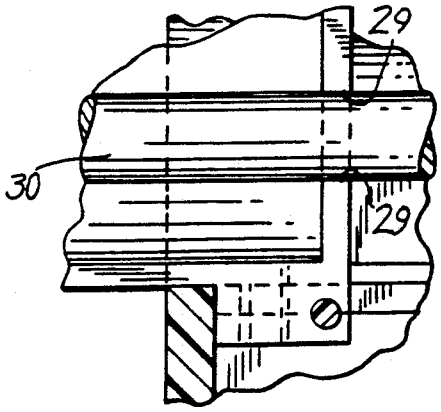

EAR PIERCING CARTRIDGE ASSEMBLY

BACKGROUND OF THE INVENTION

This invention is directed to an earlobe piercing cartridge assembly for maintaining certain types of piercing earrings sterile during storage, handling and piercing. In particular, this invention is directed to an earlobe piercing cartridge assembly that permits an earlobe to be pierced by a broad variety of piercing earring designs which have ornamental heads with large diameters and thicknesses, or ornamental heads which are thin or ornamental heads made of a soft material, or ornamental heads having shapes that do not describe a circle.

Heretofore, numerous ear piercing systems have been developed that permit the piercing of an earlobe to provide a permanent opening in an earlobe for wearing a pierced earring. The earlobe piercing cartridge assembly created by the present inventor disclosed in U.S. Pat. No. 4,030,507 enables an earlobe to be pierced by a piercing earring that remains sterile during shipping, storage and ear piercing.

The ear piercing system described and claimed in U.S. Pat. No. 4,030,507 is limited to piercing an ear with a piercing earring having an ornamental head that is either circular in shape, axially symmetrical about the piercing pin or cut from a shape that describes a circle and includes a diameter that is on the order of the diameter of the push rod of the plunger mechanism which propels the earring into the earlobe so that the piercing earring is able to withstand direct force from the push rod. In particular, by limiting the size of the ornamental head to the diameter of the push rod, the force of the push rod is uniformly applied about the surface of the ornamental head and, hence, prevents any damage to the ornamental head of the earring.

However, it is desirable to market ear piercing earrings as fashion accessories. Moreover, since for medical reasons the earrings which pierce the ear lobe should remain in the earlobe for several weeks, it is desired to permit the piercing of an earlobe with an earring that has a fashion type earring that is larger than the diameter of the push rod, is not necessarily symmetrical to the piercing pin, is considerably thinner in the axial direction than it is in diameter, or that is formed of a soft material such as karat gold and will not be damaged by the push rod during the ear piercing operation. Accordingly, an ear piercing system that obtains each of the advantages of the system described and claimed in U.S. Pat. No. 4,030,507, but also permits larger, thinner and more delicate earrings that do not necessarily describe a circle to be used with the same push rod assembly, is desired.

SUMMARY OF THE INVENTION

Generally speaking, in accordance with the invention, an earlobe piercing cartridge assembly that permits piercing an earlobe with an ornamental head that has a large diameter or is made of a thin or pliable material or which is non-symmetrical and does not describe a circle and which nonetheless permits the sterility of the piercing earring to be maintained during packaging, handling and piercing is provided. The assembly includes a piercing earring including a piercing pin and an ornamental head which may have a diameter that is not limited by the diameter of the push rod, or a thickness that is substantially reduced in proportion to the diameter of the ornamental head, or may be made of a soft material.

A cartridge uniquely configured to receive the piercing earring includes an elongated opening partially supporting the piercing pin, and a further opening proximate the ornamental head of the earring, and in longitudinal alignment with the elongated opening, the elongated opening having a smaller lateral dimension than the further opening. A shield is adapted to be retained inside the cartridge between the ornamental head of the piercing earring and the further opening to provide alignment, protection of the earring and opening of the cartridge.

Accordingly, it is an object of this invention to provide an improved sterile earlobe piercing cartridge assembly.

Another object of this invention is to provide an improved sterile earlobe piercing cartridge assembly wherein piercing of an earlobe is achieved by a piercing earring having an ornamental head that has a large diameter and includes a piercing pin extending therefrom.

A further object of this invention is to provide a sterile earlobe piercing cartridge assembly wherein piercing of an earlobe is achieved by a piercing earring having a head that is made of a thin material and includes a piercing pin extending therefrom.

Still another object of this invention is to provide a sterile earlobe piercing cartridge assembly wherein piercing of an earlobe is achieved by a piercing earring having a head that is made of a soft material such as karat gold and includes a piercing pin extending therefrom.

Still another object of this invention is to provide a sterile earlobe piercing cartridge assembly wherein piercing of an earlobe is achieved by a piercing earring having an ornamental head that does not describe a circle and is non-symmetrical about the axis of the piercing pin extending therefrom.

Still a further object of the instant invention is to provide a cartridge assembly for use with a piercing earring having various diameters, thicknesses and made of different materials that are each effectively utilized to pierce an earlobe using the same ear piercing push rod assembly.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 10 is the same view as FIG. 9 the instant the ear piercing operation is complete;

FIG. 11 is a partial sectional view taken along line 11—11 of FIG. 10;

FIG. 12 is a sectional view of the ear with piercing earring attached to clutch after the piercing operation is complete;

DETAILED DESCRIPTION OF THE PREFERRED EMBODIMENTS

Figure 1:
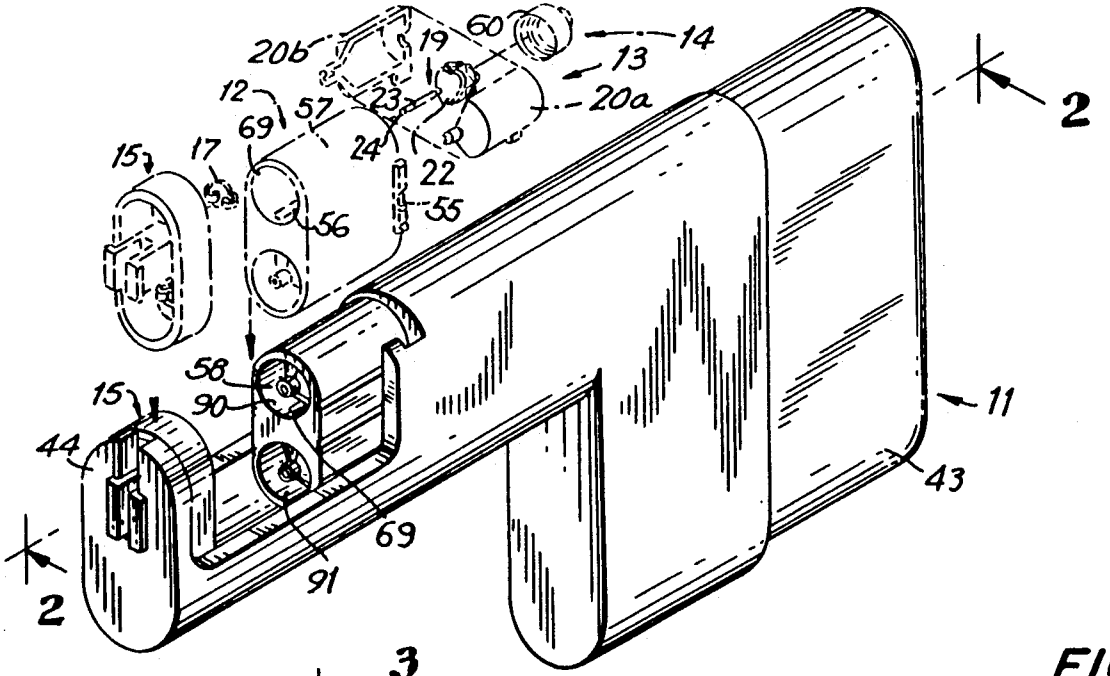
FIG. 1 is a perspective view of a sterile earlobe piercing cartridge assembly, including a phantom exploded illustration, constructed in accordance with a preferred embodiment of the instant invention.
Figure 2:
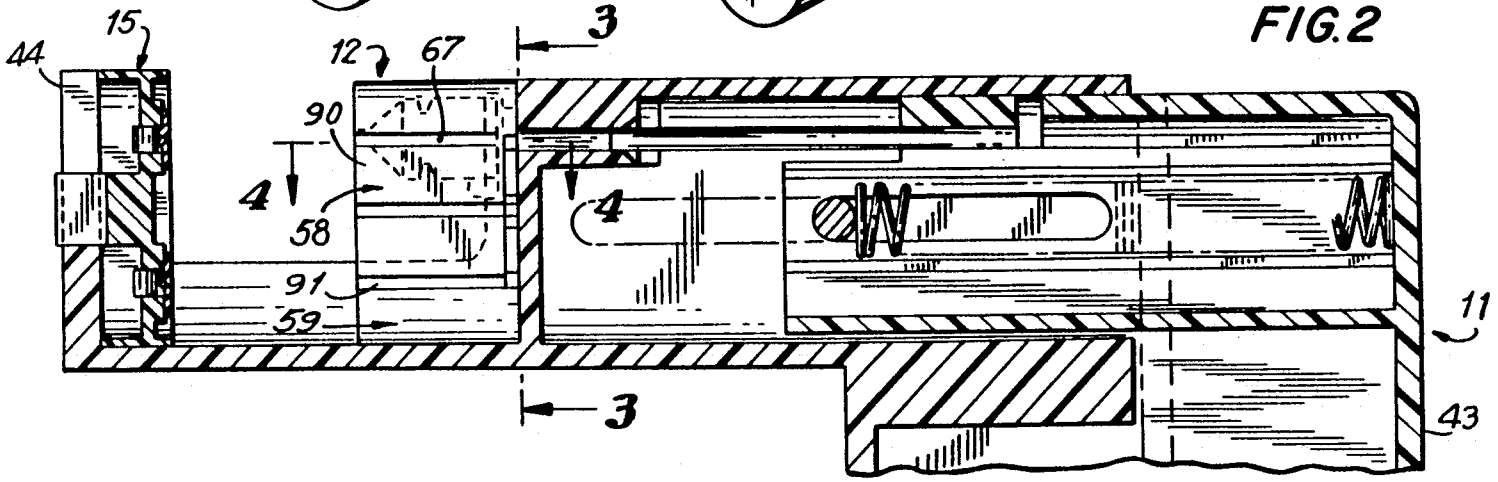
FIG. 2 is a partial sectional view of the cartridge and housing taken along line 2—2 of FIG. 1.
Figure 3:
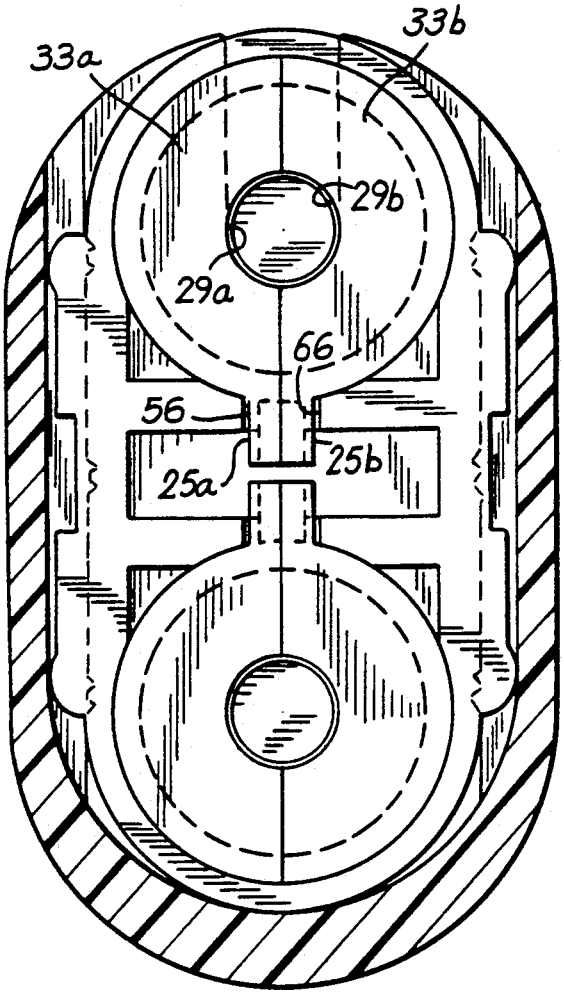
FIG. 3 is a sectional view taken along line 3—3 of FIG. 2.

FIGS. 1–12 illustrate a sterile ear piercing assembly, generally indicated at 10, constructed in accordance with the invention. In particular, ear piercing assembly 10 includes an ear piercing push rod assembly 11, which is fully disclosed in U.S. Pat. No. 4,030,507, which patent is incorporated by reference herein, as if fully set forth herein.

A cartridge housing, generally indicated as 12, is adapted to be slideably secured in push rod assembly 11 and supports therein an earring cartridge, generally indicated as 13, having therein a shield 14 at the rear of the cartridge and a piercing earring 19. Piercing earring 19 includes an ornamental head 22 and a piercing pin 23 projecting therefrom which terminates at a sharp point 24. With a large diameter on the order of 8 mm and made of thin or soft material, ornamental head 22 exemplifies the type of ornamental head which may be used as a piercing earring in the instant invention.

An earring clutch 17 is provided which secures piercing earring 19 to earlobe 45 after the piercing process is completed, as depicted in FIG. 12. A clutch cartridge 15 is adapted to receive and position earring clutch 17 to earlobe supporting wall 44 of push rod assembly 11 in the manner disclosed in U.S. Pat. No. 4,030,507.

Reference is specifically made to FIGS. 1–6 wherein earring cartridge 13 formed of two half walls **20*a* and 20*b* connected by a hinge 21 is depicted. In an exemplary embodiment the half walls forming earring cartridge 13 are polypropylene and molded to define a smooth low friction inner surface, although clearly any low friction surface will permit ear piercing to be easily affected in accordance with the objects of the instant invention. Half wall 20*a* is symmetrical with half wall 20*b* and accordingly the following description with respect to half wall 20*a* is identical with respect to half wall 20*b* and each element referred to herein with the lower case letter suffix "a" has a counterpart with the same number and the suffix "b". By way of orientation and to simplify the description of the half wall 20*a*, the length thereof is defined herein as being along the axial direction defined by the displacement of push rod 30 of push rod assembly 11**.

Half wall **20*a* includes hair-line slits 26*ay* and 26*az*, a tapering wall 32*a*, an elongated channel 31*a*, and a rear wall 33*a*. When half walls 20*a* and 20*b* are folded together, they, together with rear walls 33*a* and 33*b*, define a cavity for receiving therein shield 14 and ornamental head 22**.

Rear walls **33*a* and 33*b*, when secured together, include indentations 29*a* and 29*b*, respectively. When half walls 20*a* and 20*b* are folded together, indentations 29*a* and 29*b* define an opening for receiving push rod 30** during the ear piercing operation.

Lateral projection **25*a* projects along a half wall 20*a* at the rear of cartridge 13. Lateral projection 25*a* includes therein an opening 28. Lateral projection 25*b* includes an alignment nub 27 that is sized to be inserted into opening 28 and forms friction fit in opening 28 when half walls 20*a* and 20*b*** are folded together.

Shield 14 includes a cylindrical outer wall 60, a rear wall 61, recessed and slightly concave support wall 62 and a blind hole defined by circumfrential wall 63 and floor 64. In an exemplary embodiment shield 14 is polypropylene or any other low friction material that will slide easily within cartridge 13. As is described below, the ornamental head 22 is received and retained against support wall 62. Moreover, if the rear portion of the ornamental head is round or spherical, the ornamental head will rest against support wall 62 and be seated in the blind hole defined by circumfrential wall 63 and floor 64.

During assembly of earring cartridge assembly 12, piercing earring 19 and shield 14 are positioned in one of the half walls **20*a* or 20*b*. Thereafter, half walls 20*a* and 20*b* are folded along hinge 21 so that piercing earring 19 and shield 14 are disposed in earrinq cartridge 13. Specifically, piercing pin 23 is positioned to define an interference fit in elongated channels 31*a* and 31*b*. Ornamental head 22 rests against support wall 62 of shield 14**.

As is best illustrated in FIGS. 1–4, cartridge housing 13 includes an ovally shaped outer tubular housing wall 57. Two chambers, 58 and 59, are disposed therein and each chamber extends through the axial length of the housing 12 to define interior cylindrical walls 90 and 91, respectively. Vertically oriented laterally projecting flanges **55*a* and 55*b* are supported by housing wall 57 and are adapted to be received in track recesses 14*a* and 14*b* defined in push rod assembly 11**.

On the interior of cylindrical walls 90 and 91 are opposed spaced ribs 66 extending along the length of chambers 56 and 57 on the upper and lower portion thereof. Opposed spaced ribs 66 define a track for receiving therein the flange **25*a* and 25*b*. Additionally, on each lateral wall of chambers 58 and 59 are opposed ribs 67 which assist in centering earring cartridge 13 when it is positioned in chambers 58 and 59. Finally, a retaining lip 69 extends inwardly at the exit ends of chambers 58 and 59 for retaining the cartridge in the chamber opening at the completion of the ear piercing operation. Accordingly, after two cartridges 13 are assembled in the manner discussed above, they are inserted into housing 12** and are positioned therein in the manner illustrated in FIG. 4.

In commercial use, after the assembly of piercing earring 19, earring cartridge 13 and cartridge housing 12, the entire assembly is packaged to be ready for use at a later time. The package which is provided for the assembled cartridge housing and clutch cartridge can be sealed by gas pervious tape, whereafter the sterilized gas is introduced into the package to thereby sterilize the piercing earring and clutch and insure that same are maintained sterile during storage, handling and piercing.

Prior to the piercing process, cartridge housing 12 is inserted into push rod assembly 11. Vertically-oriented lateral flanges 55*a* and 55*b* of cartridge housing 12 are adapted to be slideably secured into track recesses 14*a* and 14*b* of push rod assembly 11.

Reference is made to FIGS. 1, 4 and 8 through 10 to understand the operation of the ear piercing assembly of the instant invention. Specifically, clutch cartridge 15 and housing 12 are removed from a sterile package and inserted into push rod assembly in the manner illustrated in FIG. 1. By fully inserting the housing and clutch assembly into the push rod assembly, the earring cartridge and clutch are automatically brought into axial registry with the push rod 30.

Figure 4:
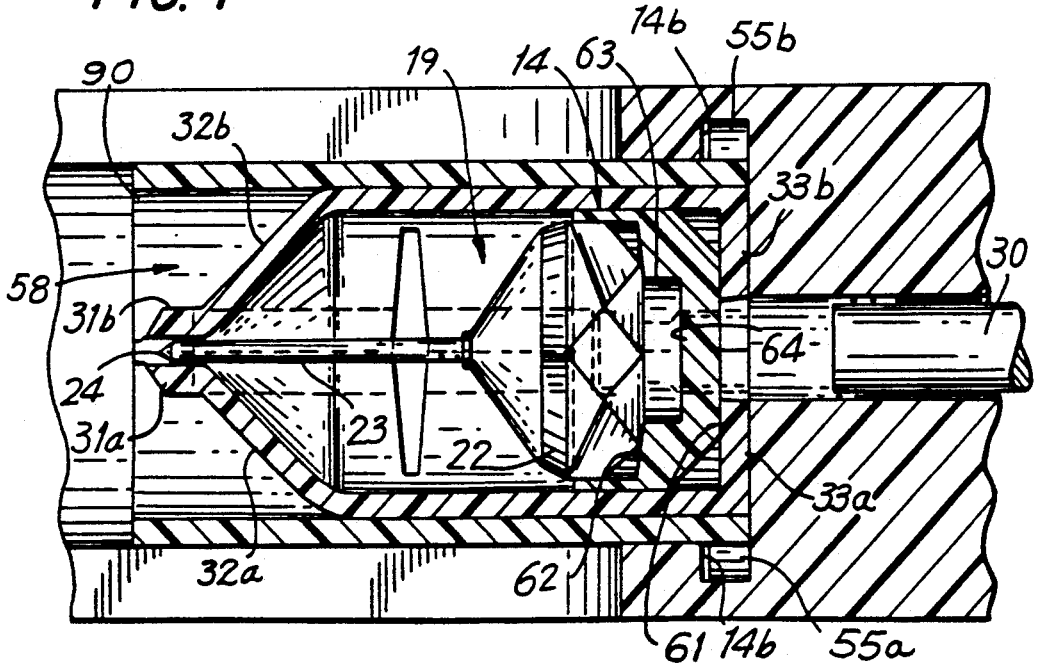
FIG. 4 is a sectional view taken along line 4—4 of FIG. 2.
Figure 5:
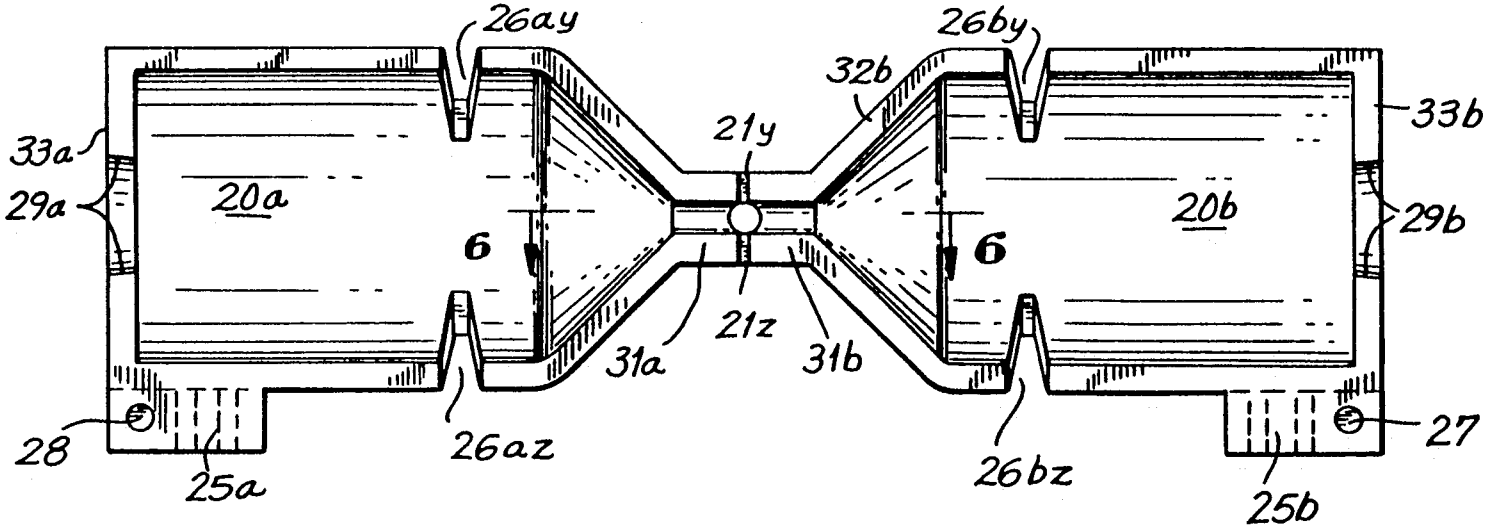
FIG. 5 is an elevational view of a cartridge constructed in accordance with the preferred embodiment of the invention.

Next, the push rod assembly is positioned at an ear lobe so that the ear lobe is disposed in the space between the housing 12 and the clutch assembly 15. As illustrated in FIG. 4, at the ready position, the push rod 30 is in a first position, and earring 19 is disposed in earring cartridge 13. By applying a slight pressure to the plunger handle 43 of push rod assembly 11, the push rod 30 pushes the cartridge forward to a first intermediate ready position, illustrated in FIG. 8, where the front end of the cartridge can be aligned with the position on the ear lobe where the piercing is to occur.

Next, upon pushing the plunger handle, push rod 30 enters the opening defined by indentation 29*a* and 29*b*. As the plunger handle 43 continues to be squeezed the push rod 30 is driven forward in the axial direction illustrated by the arrow C in FIG. 10 and enters the opening formed by indentation 29*a* and 29*b* thereby bringing push rod 30 into engagement with shield 14 in the manner indicated in FIG. 9. Push rod 30 continues to push shield 14 in the axial direction so that shield 14 distributes the force of the push rod 30 over the entire area of the ornamental head as it pushes the earring forward in the cartridge so that the piercing pin 23 is projected through the opening defined by half walls 20*a* and 20*b*. By distributing the weight across the entire area of the ornamental head, no damage or abrasion will occur to the ornamental head even though the size thereof is much larger than the diameter of push rod 30 or the ornamental head is made of a soft material that would otherwise be distorted by the force of push rod 30. Additionally, the low friction outer wall 60 of the shield 14 engages the low friction inner surfaces of tapered walls 32*a* and 32*b* of the cartridge and drive the walls 32*a* and 32*b* laterally apart so that the enlarged head is able to clear the tapered walls 32*a* and 32*b* as the piercing pin 23 is driven through the ear lobe and into clutch 17.

As illustrated in FIG. 11, at the completion of the ear piercing operation, the push rod 30 is resting against the recesses 29*a* and 29*b* that define the opening of the cartridge and are in slight frictional engagement therewith. Accordingly, as pressure is released from the trigger 43, the push rod brings the cartridge back into the housing thereby allowing half walls 20*a* and 20*b* to collapse and be returned to a folded position so that the cartridge is returned into the chamber in the housing in the manner illustrated in FIG. 12 so that the earring and the ear lobe can be removed from the push rod assembly after piercing is completed.

Figure 7:
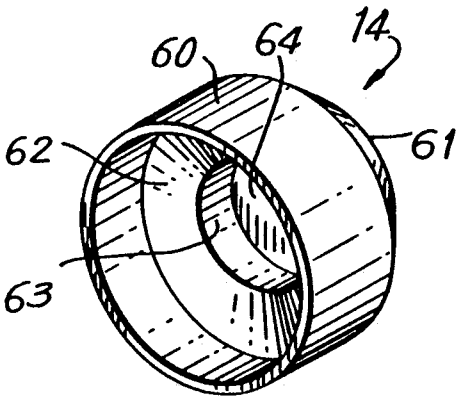
FIG. 7 is a perspective view of a shield constructed in accordance with the invention.
Figure 6:
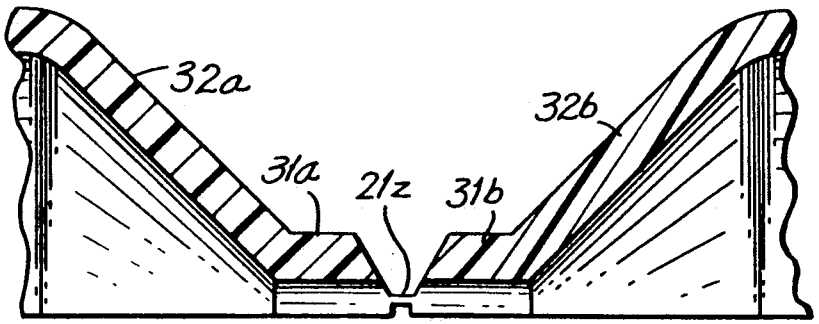
FIG. 6 is a sectional view taken along line 6—6 of FIG. 5.
Figure 8:
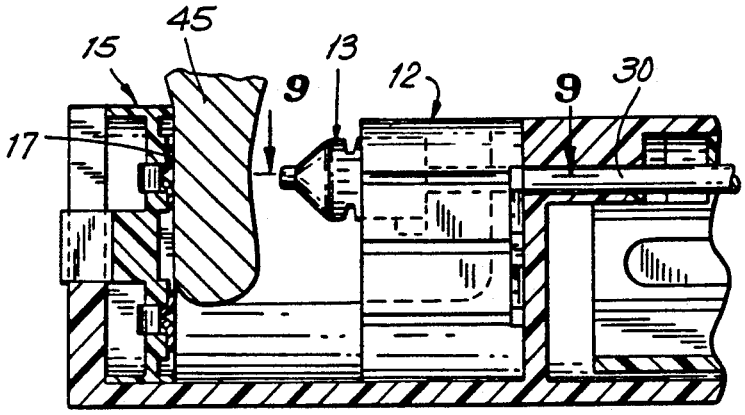
FIG. 8 is a partial view of FIG. 2 when the ear piercing operation is in progress.
Figure 9:
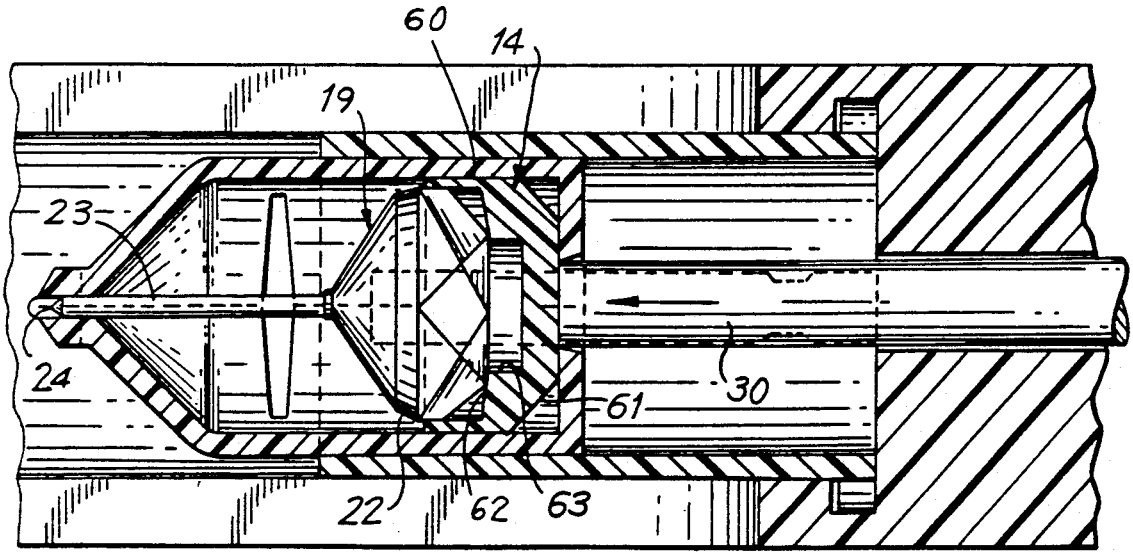
FIG. 9 is a sectional view taken along line 9—9 of FIG. 8.

The instant invention is particularly characterized by a cartridge assembly and shield that in combination permit earrings having an unusual configuration, or a large diameter head, to be discharged from a cartridge by interaction of the cartridge and the shield. Moreover, the instant invention is also characterized by the use of a shield to prevent earrings having an unusual configuration or large diameter from being damaged or distorted by the force of the push rod which facilitates alignment of the earring and opening of the cartridge. Although the shield illustrated in FIG. 7 is presented by way of example, the shield can take on other configurations.

Figure 13:
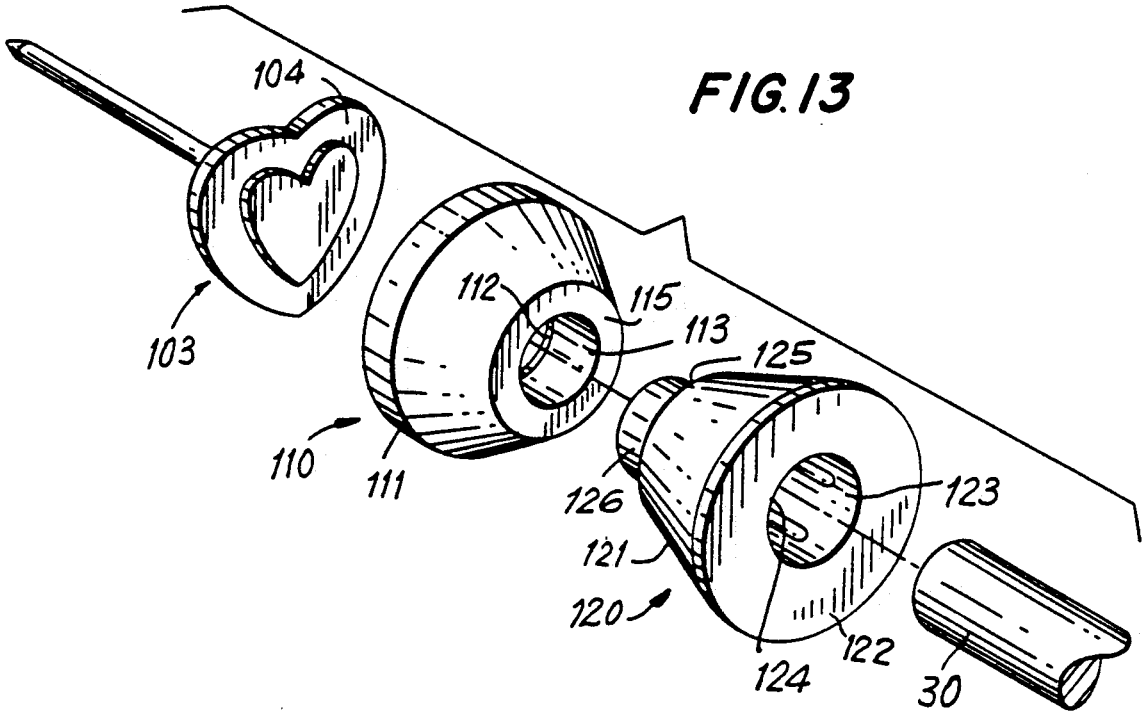
FIG. 13 is an exploded perspective view of a further embodiment of a two-piece shield and ear piercing earring in accordance with the instant invention.
Figure 14:
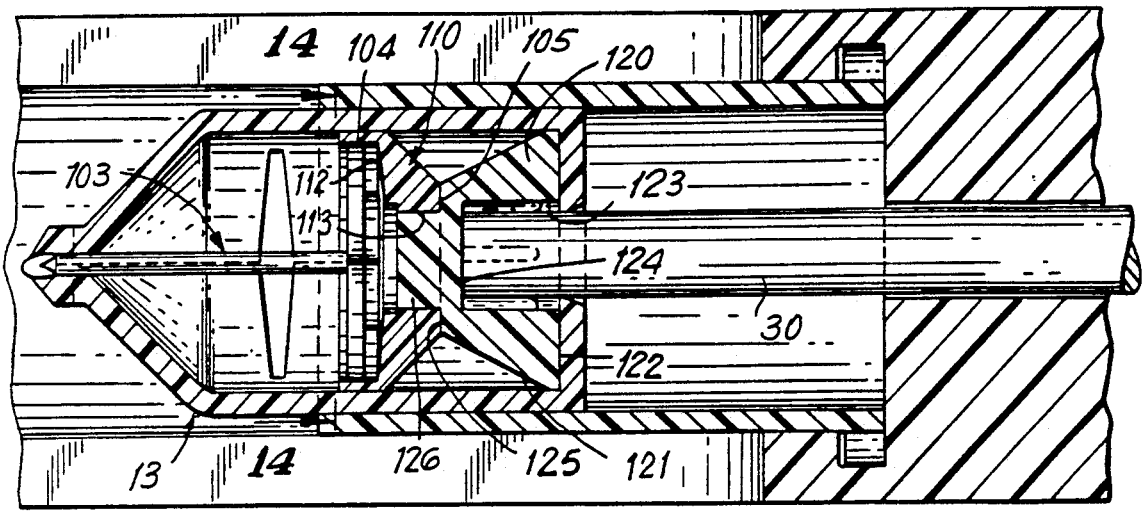
FIG. 14 is a sectional view of the cartridge and housing including the two-piece shield and thin ornamental head piercing earring depicted in FIG. 13.
Figure 15:
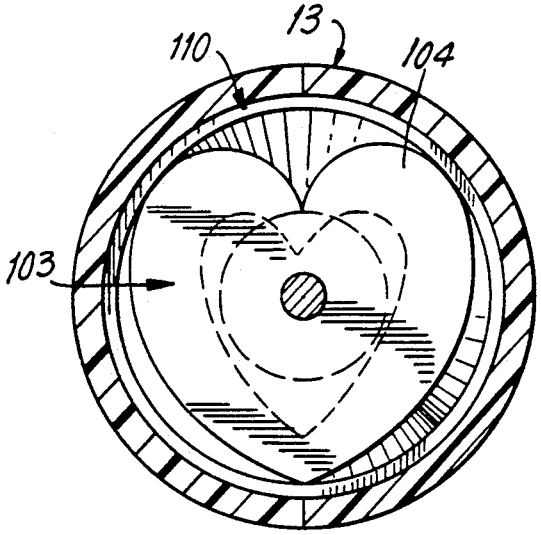
FIG. 15 is a sectional view taken along line 14—14 of FIG. 14.

For example, a two-piece shield assembly in accordance with another embodiment of the instant invention is illustrated in FIGS. 13–15. Reference is specifically made to FIG. 13, wherein piercing earring 103 includes, for example, a thin heart-shaped ornamental head 104 which is considerably thinner than the ornamental head 22 of piercing earring 19 shown in FIG. 4. The purpose of the two-piece shield is alignment of the axis of the shield to the push rod and to accommodate the space created by the extra distance remaining between the thin ornamental head and the distance that the push rod is displaced. Specifically, the distance the push rod is required to be displaced to engage the cartridge and then the shield cannot be practically varied when a piercing earring having a thin ornamental head is used in lieu of a thicker ornamental head. Thus, in order to assure that the push rod displaces the cartridge shield and, hence, the piercing earring through an ear lobe and into a clutch in accordance with the object of the instant invention, a two-piece shield 100 admits of an axial dimension that takes up the space between the spacer and that of the thin ornamental head that would have been occupied by a thicker ornamental head to aligning of its axis to the push rod. Two-piece shield 100 includes a first female piece 110 and a second male piece 120. Male piece 120 includes frusto conical shaped outer wall 121, front wall 122 and a blind hole formed by inner wall 123 and floor 124. Frusto conical wall 121 ends in a rear wall 125 which includes a cylindrical projection 126. Female piece 110 includes an outer wall 111, a recessed support wall 112, and a through hole defined by inner wall 113.

As shown in the exploded view of FIG. 13, cylindrical projection 126 of male piece 120 is inserted in the through hole defined by inner wall 113 of female piece 110. As is illustrated in FIG. 14, push rod 30 will engage floor 124 of male piece 120 and insure that male piece 120 and female piece 110 together operate in the same manner as discussed above with respect to shield 14.

Accordingly, each of the earring shield and cartridge assemblies disclosed herein are adapted to permit ear piercing using earrings having a large head, such as an 8 mm ball earring or an earring having an unusual or irregularly shaped head made out of soft material such as karat gold. The unique cartridge assembly of the instant invention is adapted to be used with the push rod assembly described in U.S. Pat. No. 4,030,507 and which is reusable with each new differently shaped or differently sized sterilely-packed earring cartridge and cartridge housing. Thus, the piercing earring is utilized as a training or permanent earring and is worn until the hole in the earlobe conforms, whereafter other pierced earrings can then be inserted therein.

It is further noted that among the benefits which enure to the instant invention is the ability to use a jewelers style fashion earring having an ornamental head which has a diameter of up to 8 mm without requiring the diameter of the piston (usually on the order of about 3 mm) to be varied, or an ornamental head which is made of a soft material such as karat gold.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ear piercing assembly comprising in combination:

a piercing earring including an ornamental head and a piercing pin projecting from the head;

a cartridge adapted to receive the piercing earring and substantially envelope the piercing earring, the cartridge including an elongated opening partially supporting the piercing pin, and a further opening proximate the ornamental head of the earring, said further opening being in axial alignment with the elongated opening, the elongated opening having a smaller lateral dimension than the further opening;

a shield means positioned within said cartridge between the ornamental head of the piercing earring and the further opening so that the pressure across the ornamental head from a push rod which enters the further opening is distributed by said shield means; and a housing means for receiving the cartridge and for positioning the cartridge openings in alignment with a push rod to prevent displacement of the cartridge when a push rod is displaced through the earring cartridge.

2. The ear piercing assembly of claim 1, wherein the earring cartridge is constructed and arranged so that a portion of the cartridge defining the further opening is engaged by a push rod when the cartridge is displaced by a push rod from a rest position to an intermediate displaced position, the cartridge being adapted to be brought into contact with the smaller opening of the housing chamber means to prevent the cartridge from being ejected from the chamber means and to define the intermediate displaced position, so that the entry of a push rod through the further opening into contact with the shield means will result in the earring being indirectly forced through the elongated cartridge opening.

3. The ear piercing assembly of claim 2, wherein the earring cartridge is defined by two identical half-walls, the half-walls being joined by hinge means to permit the half-walls to be folded onto each other and substantially envelop the piercing earring, the half-walls defining hairline slits therebetween along the lengthwise extent of the cartridge to allow the elongated opening to expand and hinge in response to a forcing of the shield means therethrough.

4. The ear piercing assembly of claim 3, wherein the hinge means includes a hinge disposed at the end of the elongated opening.

5. The ear piercing assembly of claim 4, wherein the hinges disposed at the end of the elongated opening are dimensioned to permit the hinges to break in response to the shield means being forced into said elongated opening and thereby permit the half-walls to expand along the hairline slits and permit the earring to be forced therethrough.

6. The ear piercing assembly of claim 2, wherein the cartridge has a projection extending axially at the rear of the cartridge, and the housing means has a track adapted for receiving and guiding the projection when a push rod means is displaced from an initial position to an intermediate displaced position.

7. The ear piercing assembly of claim 2, and including a clutch adapted to be secured onto the piercing earring, and a clutch cartridge releasably secured to the earlobe support means, the clutch cartridge positioning the clutch in longitudinal alignment with the elongated cartridge opening, whereby the elongated opening guides the earring piercing pin into the clutch as the earring is forced from the cartridge.

8. The ear piercing assembly of claim 2, wherein the ornamental head is made of a material that is softer than the push rod.

9. The ear piercing assembly of claim 1, wherein the shield means includes a first piece and a second piece adapted to be positioned with respect to each other so that the ear piercing earring having a thin ornamental head is securely positioned in said cartridge and is aligned axially with the piercing pin.

10. The ear piercing assembly of claim 1, wherein the housing means includes at least one chamber having a first opening for inserting the cartridge, and a second opening of smaller diameter than said second opening to restrain said cartridge from being displaced out of said chamber when said cartridge is brought into proximity to said earlobe during piercing.

11. The ear piercing assembly of claim 1, wherein the ornamental head has a diameter no greater than 8 mm.

* * * * *